US011077334B2

(12) United States Patent
Hsieh

(10) Patent No.: US 11,077,334 B2
(45) Date of Patent: Aug. 3, 2021

(54) ROWER WITH ARTICULATING FOOTPADS

(71) Applicant: Paradigm Health and Wellness, City of Industry, CA (US)

(72) Inventor: Paul Hsieh, City of Industry, CA (US)

( * ) Notice: Subject to any disclaimer, the term of this patent is extended or adjusted under 35 U.S.C. 154(b) by 90 days.

(21) Appl. No.: 16/519,983

(22) Filed: Jul. 23, 2019

(65) Prior Publication Data

US 2020/0023231 A1 Jan. 23, 2020

Related U.S. Application Data

(60) Provisional application No. 62/702,139, filed on Jul. 23, 2018.

(51) Int. Cl.

| | |
|---|---|
| ***A63B 21/00*** | (2006.01) |
| ***A63B 22/00*** | (2006.01) |
| ***A63B 22/20*** | (2006.01) |

(52) U.S. Cl.

CPC ..... *A63B 21/4034* (2015.10); *A63B 21/154* (2013.01); *A63B 21/4035* (2015.10); *A63B 22/0076* (2013.01); *A63B 22/203* (2013.01); *A63B 2022/0079* (2013.01)

(58) Field of Classification Search

CPC ..... A63B 22/0076–22/0087; A63B 69/06–2069/066; A63B 21/151–156; A63B 21/4034; A63B 22/203; A63B 21/4035; A63B 21/154; A63B 2022/0079; A63B 71/0036; A63B 2208/0238; A63B 2208/0204; A63B 2225/10; A63B 1/00; F16H 7/18

USPC ..... 474/139, 131

See application file for complete search history.

(56) References Cited

U.S. PATENT DOCUMENTS

| | | | | |
|---|---|---|---|---|
| 481,730 | A | 8/1892 | Miller | |
| 885,074 | A | 4/1908 | Nidever | |
| 913,799 | A | 3/1909 | Zund-Burguet | |
| 936,830 | A * | 10/1909 | Tenpas | F16H 7/18 474/123 |
| 3,764,132 | A | 10/1973 | Hepburn | |
| 4,010,948 | A | 3/1977 | Deluty | |
| 4,114,875 | A | 9/1978 | Deluty | |
| 4,591,150 | A | 5/1986 | Mosher | |
| 4,974,832 | A * | 12/1990 | Dalebout | A63B 21/00069 482/138 |

(Continued)

OTHER PUBLICATIONS

ICON Health & Fitness, Inc. (2014). Pro-Form 440R: User's Manual. China: ICON IP, Inc. (Year: 2014).*

*Primary Examiner* — Jennifer Robertson
*Assistant Examiner* — Catrina A Letterman
(74) *Attorney, Agent, or Firm* — Kirk A. Buhler; Buhler & Associates

(57) ABSTRACT

Improvements in a rower with articulating footpads. The footpads have first (raised) position that uncovers wheels that allow for easy transportation of the rowing machine from one location to another. In this position the footpads are prevented from dragging on the floor when the rowing machine is being transported. The second position of the footpads rotate over the structural stability frame member. This orientation provides two flat surfaces for the user to stand upon. The footpads have a rear lip to locate the back or heels of the user. A strap is pulled from a loading mechanism and is guided out of the loading system to allow the strap to be pulled out of the loading system from a variety of angles.

21 Claims, 4 Drawing Sheets

(56) References Cited

U.S. PATENT DOCUMENTS

| | | | | |
|---|---|---|---|---|
| 6,071,215 | A | 6/2000 | Raffo et al. | |
| 6,126,580 | A | 10/2000 | Francis et al. | |
| 6,440,044 | B1 | 8/2002 | Francis et al. | |
| 2019/0201740 | A1* | 7/2019 | Robert | A63B 1/00 |

* cited by examiner

ROWER WITH ARTICULATING FOOTPADS

CROSS REFERENCE TO RELATED APPLICATIONS

This application claims the benefit of Provisional Application Ser. No. 62/702,139 filed Jul. 23, 2019 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a rowing exercise machine. More particularly, the present rower has articulating footpads located on opposing sides of the loading mechanism to allow a user to stand on flat pad platforms to perform additional exercises to vertically lift the rowing handle.

Description of Related Art Including Information Disclosed Under 37 CFR 1.97 and 1.98

Rowing machines are produced to re-create the exercise that is performed by a person that is rowing a boat. The user sits on a sliding platform with their feet restrained in footpads. The user pulls on a tube to exercise both their legs, arms and torso. At the end of the stroke the person returns the tube to the starting position. A loading mechanism in a front housing can be a variety of loading/resistance types from fans to strap (prony) brakes, motors or magnetic brakes. Rowing machines are typically designed to perform a specific exercise, and often a user may want to perform additional exercises from a standing position. Due to the limited weight of the loading system, performing a vertical lifting is limited to low weight exercises that are less than the weight of the rowing machine. If a user should rapidly lift or jerk on the tube they may also be able to lift some of the rowing machine. Another difficulty of vertical lifting exercise is that the pull strap is only designed to be pulled in a horizontal direction.

A number of patents and or publications have been made to address rowing machines or combination exercise machines that allow for a rowing exercise. Exemplary examples of patents and or publication that try to address this /these problem(s) are identified and discussed below.

U.S. Pat. No. 4,591,150 was patented on May 27, 1986 to Bruce A. Mosher and is titled Exercise Device. This patent discloses an exercise device consisting of two telescoping longitudinal members that are interconnected by an elastic cable is characterized by having an auxiliary cross member affixed on the tubular longitudinal member near the open end of it where the other longitudinal member enters it. This auxiliary cross member permits an increased repertoire of exercises to be performed with the device, including rowing exercises curls and archery pulls.

U.S. Pat. No. 7,226,397 was patented on Jun. 5, 2007 to Douglas B. MacDonald and is titled Rowing Exercise Machine. This patent discloses a rowing exercise machine includes a resistance mechanism having a first coupling between first and second spaced disks and resiliently deformable and tensionable in a spiral therebetween to resist rotation, and a second coupling between one of the disks and a user handle to resist movement of the handle and concordant movement of the user on a seat along a track. While this patent discloses using the machine to perform curl exercises the exercises are performed in a seated position.

A company called Proform sells a combination rower and strength station that is designated as 440R. In this rower, a pair of footpads are fixed to a horizontal frame member. The footpads do not rotate over the frame member and require the user to lean over the loading mechanism to perform a vertical pull of the strap. This product elongates the overall length of the rowing machine and also does not include wheels to allow easy re-locating of the rowing machine.

What is needed is a rower with articulating footpads to reduce the overall length of the rowing machine and allows a user to easily move or roll the rowing machine. The foot pedals also prevent the user from lifting the rower off the floor. If there were no platforms on the front stabilizer, an intense pull directly, up would lift the entire rower off the floor in an unsafe manner. The foot pads are also used as a flat surface to allow users a stable surface to stand on when they perform lifting exercises. The proposed rower in this document provides the solution.

BRIEF SUMMARY OF THE INVENTION

It is an object of the rower with articulating footpads to enable the footpads to rotate above a structural stability frame member. The footpads can be positioned to uncover wheels that allow for easy transportation of the rowing machine from one location to another. In this position, the footpads are prevented from dragging on the floor when the rowing machine is being transported. The use of two parallel spaced wheels increases the stability of the rowing machine as it is being moved. In the lifted position of the footpads, the overall length of the rowing machine is reduced. The user can lower the footpads and use the rowing machine without the extended overall length. The footpads flip or articulate to a position adjacent to the sides of the body of the loading mechanism and within the width of the stabilizing frame.

It is an object of the rower with articulating footpads to enable the footpads to rotate over the structural stability frame member. This orientation provides two flat surfaces for the user to stand upon. This raises the height of the standing platform(s) but also eliminates the obstruction of the supporting frame where the user must avoid or contort their foot to stand on the frame. The weight of the user provides a vertical load to the rowing machine to increase the amount of resistance that can be applied to the lifting strap. The footpads have a rear lip to locate the back or heels of the user and the user can position themselves to vertically pull the strap from the loading mechanism.

It is another object of the rower with articulating footpads for the tension strap to be guided out of the loading system to allow the tension strap to be pulled out of the loading system from a variety of angles as opposed to limiting the pull to a horizontal pull, as would be normal for a rowing exercise. The strap is guided by a flanged pulley and a tapered pulley to center the strap during the travel of the strap into and out of the loading mechanism. The use of a strap allows for higher loads that can be obtained from a rope or cord and helps to maintain an even spooling of the strap on and around the loading mechanism.

It is still another object of the rower with articulating footpads for the loading mechanism to provide high loading forces. In a rowing machine the exercise is typically aerobic in nature, whereas in curling and lifting exercises the workout is more anaerobic and requires higher loads that are not typical of rowing machines. The loading mechanism provides higher load levels to provide a challenging workout for lifting exercises. The foot pads allow for the higher loads in lifting exercises. The user's weight holds down the frame when the user is performing vertical pulls on the tube.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
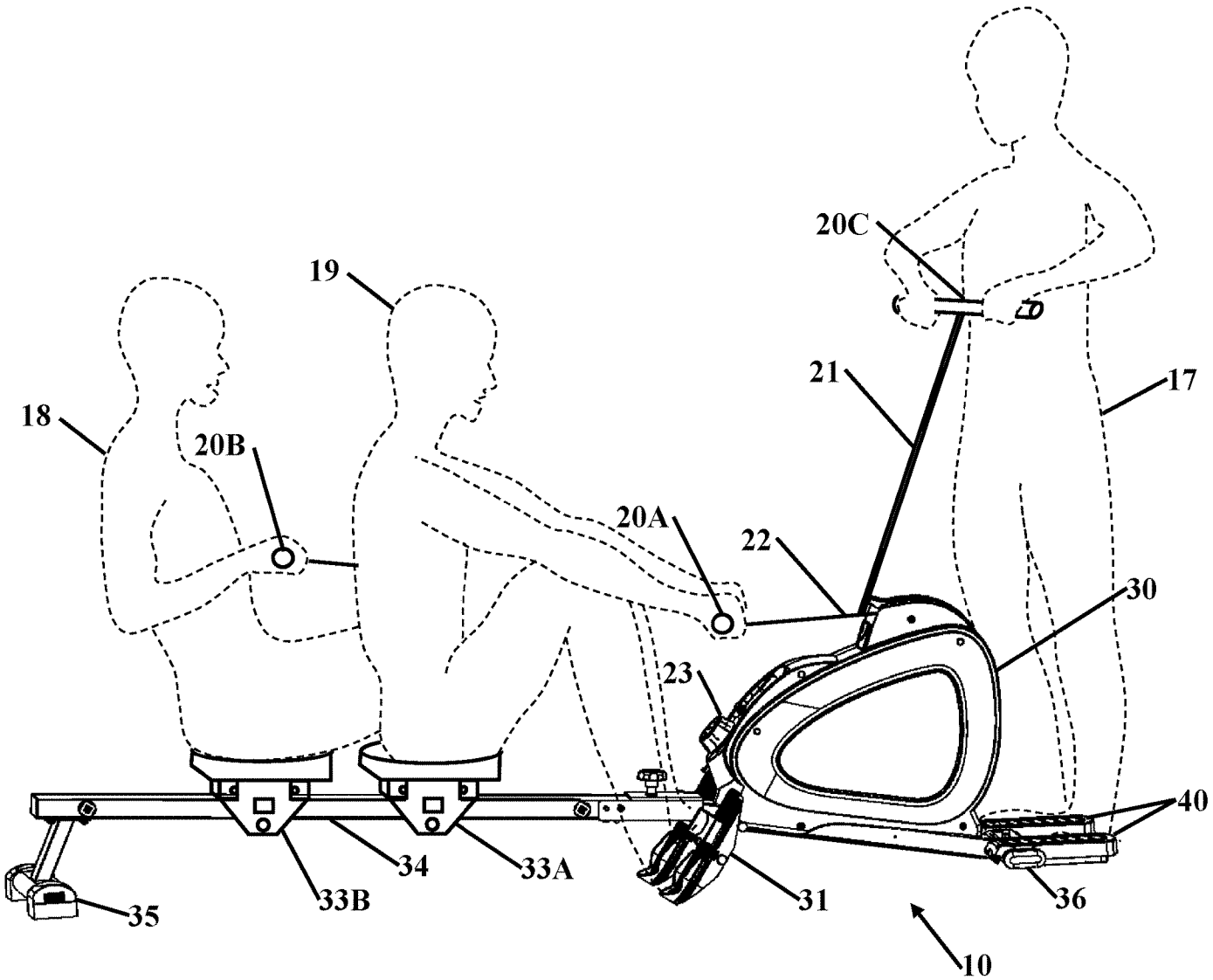
FIG. 1 shows a rower with articulating footpads with the two embodiments of using the rower.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention but is merely representative of various embodiments of the invention. The illustrated embodiments of the invention will be best understood by reference to the drawings, wherein like parts are designated by like numerals throughout.

| Item Numbers and Description | | |
|---|---|---|
| 10 rower | 17 curl exercise position | 18 rower extended |
| 19 rower beginning position | | 20 pull tube |
| 21 strap curl position | 22 strap rowing position | 23 tension control |

-continued

| Item Numbers and Description | | |
|---|---|---|
| 24 strap over tube | 25 strap | 26 strap transition |
| 27 wheel | 28 foot pad | 29 end cap |
| 30 loading housing/ enclosure | 31 rowing foot restraints | 32 ground clearance taper |
| 33 A/B row slider | 34 track | 35 rear foot |
| 36 cross-tube | 38 axle | 39 axle bracket |
| 40 flip over foot pads | 41 raised heel edge | 42 opening |
| 43 footpad link | 50 "U" pulley | 51 tapered pulley |
| 52 slot | 53 flanges | 54 taper |
| 55 axles | 56 angle | 97 drive belt |
| 98 retracting pulley | 99 flywheel | |

30 loading housing/enclosure 31 rowing foot restraints 32 ground clearance taper

34 track 35 rear foot

33A/B row slider

FIG. 1 shows a rower with articulating footpads 10 with the two embodiments of using the rower. The rower 10 has a loading housing 30 that places a load on the strap curl position 21 or the strap rowing position 22 when a person is exercising. To use a typical rowing machine a user in the rower extended 18 position or in the rower beginning position 19 sits on a row slider 33 and secures their feet in rowing foot restraints 31. The user will then grasp the pull tube 20A and moves between a forward rower beginning position 19 with their knees bent to a rearward position 18 with their legs extended as they pull on the pull tube 20B. The trolley will move from a forward position row slider 33A to a rearward position row slider 33B as the trolley rolls on the track 34. To alter the amount of resistance from the pull there is a tension control 23. The strap rowing position 22 is retracted within the loading housing 30 as the person moves towards the loading housing 30. The user pulls on the strap rowing position 22 to withdraw the strap from the loading housing 30. Resistance or load is placed on the strap rowing position 22 as it is pulled out of the loading housing 30.

The rowing machine is supported on rear feet 35 and a cross tube 36 that is placed on opposite elongated sides of the rowing machine 10. The cross tube 36 has a plurality of wheels or rollers (shown in other figures herein) to allow the user to lift the rear and of the rowing machine and move the rowing machine 10. To perform curling or lifting exercises, the user flips over footpads 40 to rotate the footpads over the cross tube 36 and over the wheels 27. With the footpads placed over the wheels 27, movement or rolling of the rower 10 is essentially inhibited. Placing the footpads 40 in a horizontal orientation provides the user in a curl exercise position 17 a flat platform to stand upon. This also allows a load to be placed on the rower 10 and prevents lifting of the rower 10 as the user 17 pulls the strap curl position 21 in the curl position, shrugs or vertical lift by lifting the pull tube 20C. The footpads 40 are connected to a pivoting axle that allows the footpads to separately or collectively rotate to a horizontal orientation for use and a rotated orientation to allow the rollers to be used to move the rower 10.

Figure 2:
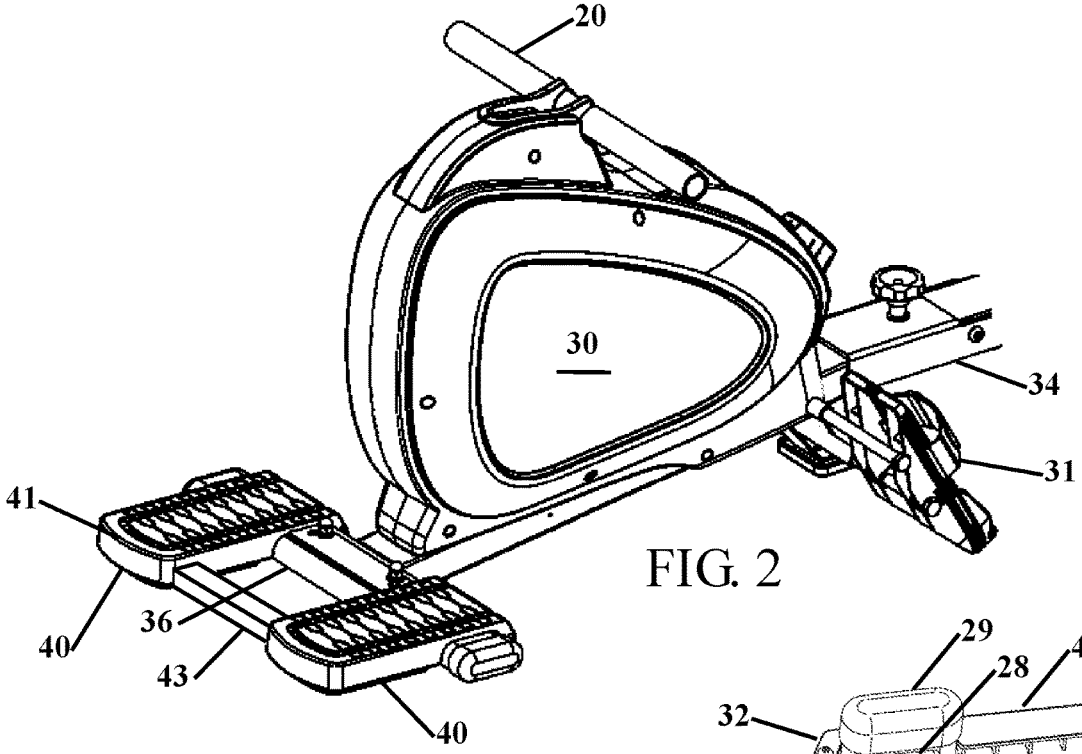
FIG. 2 shows a first position of the footpad.
Figure 3:
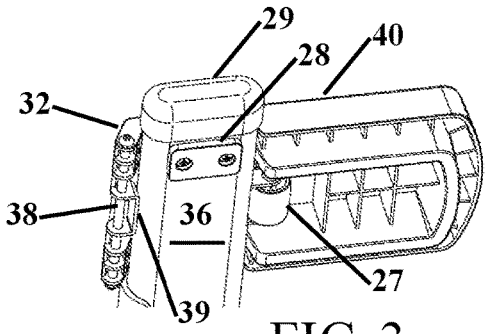
FIG. 3 shows the underside of the footpad.
Figure 4:
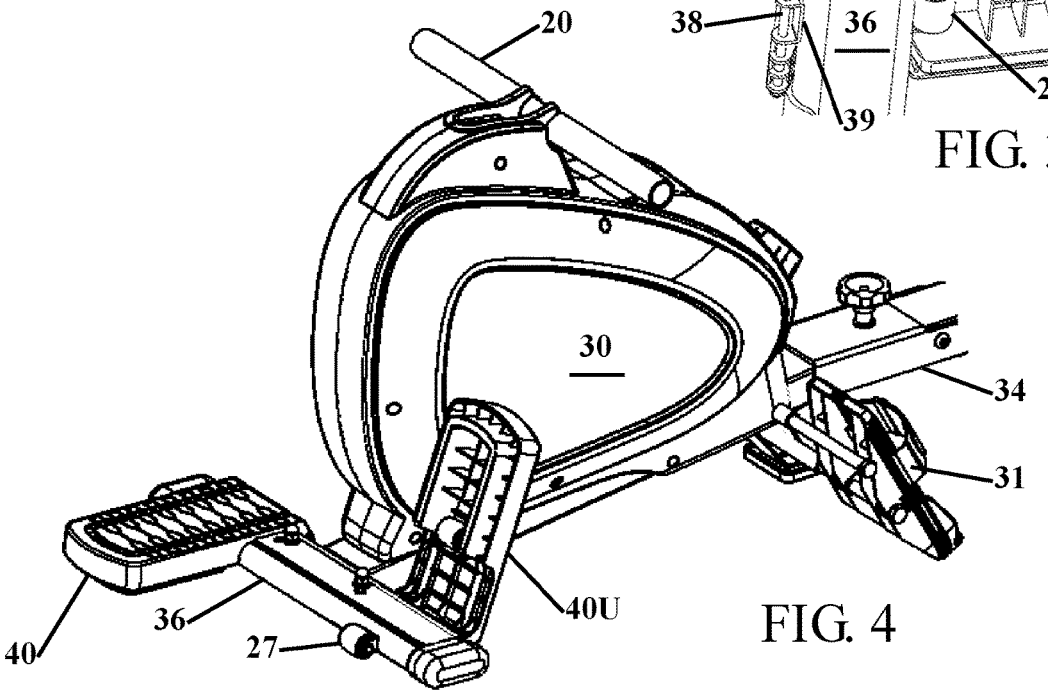
FIG. 4 shows a second position of the footpad.

FIG. 2 shows a first position of the footpad 40, FIG. 3 shows the underside of the footpad 40 and FIG. 4 shows a second lifted upper position of the footpad 40U. From FIG. 2, to achieve additional workout, the user's weight must be on the front stabilizer cross tube 36 to hold the frame down. Without the footpads 40, if the user stood on the floor, pulling vertically on the pull tube 20 would lift the rower and loading housing 30 off of the ground. The footpads are shown with an optional footpad link 43 that allows the two footpads to move as a single unit. In FIG. 4, one of the footpads 40U is raised to expose a wheel 27. Another wheel 27 is located under the other footpad. While two separate footpads 40 are shown and described, it is contemplated that a single footpad could be used and linked around both sides of the loading housing 30.

FIG. 3 shows the underside of the footpad 40 ground clearance taper 32. The ground clearance taper 32 ensures that the footpad 40 does not make contact with the ground when rolling/moving the rower on the wheel(s) 27. The footpad(s) 40 pivot on a pin or axle 38. The pin or axle 38 is secured with an axe bracket 39 to the cross-tube. In the bottom of the cross tube 36 is a footpad 28 that elevates the cross tube 36 above the ground. An end cap 29 closes the end of the cross tube 36. There is a raised heel edge 41 to allow a user to position their feet on the footpad(s) 40. The front footpad(s) 40 provide a comfortable flat surface. Otherwise the user's feet would be half on the front stabilizer cross tube 36 and half on the floor.

The footpad(s) 40 flip up and out of the way to allow for clearance for the transport wheels 27 on the front stabilizer cross tube 36. When the footpad(s) 40U are lifted to the raise orientation, as one footpad 40U is shown in FIG. 4. The top of the opposing footpad 40 is elevated but still level or parallel with the ground. There is a maximum flip back position to footpad 40U that prevent the footpad(s) 40U from dragging on the floor when the unit is being transported. The axle bracket 39 has a stop that limits the rearward rotation.

Figure 5:
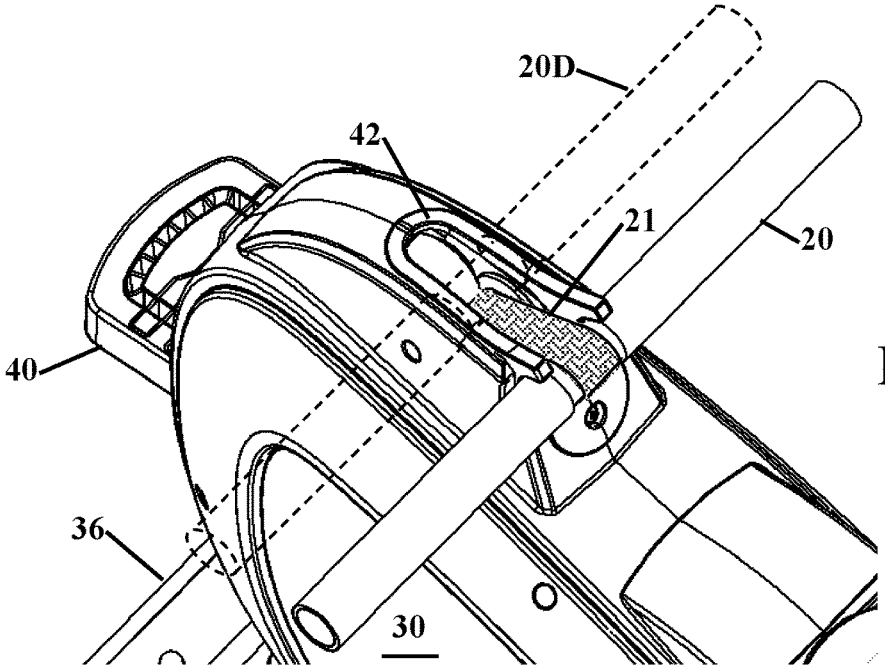
FIG. 5 shows a top perspective view of the pull tube entering the loading housing.
Figure 6:
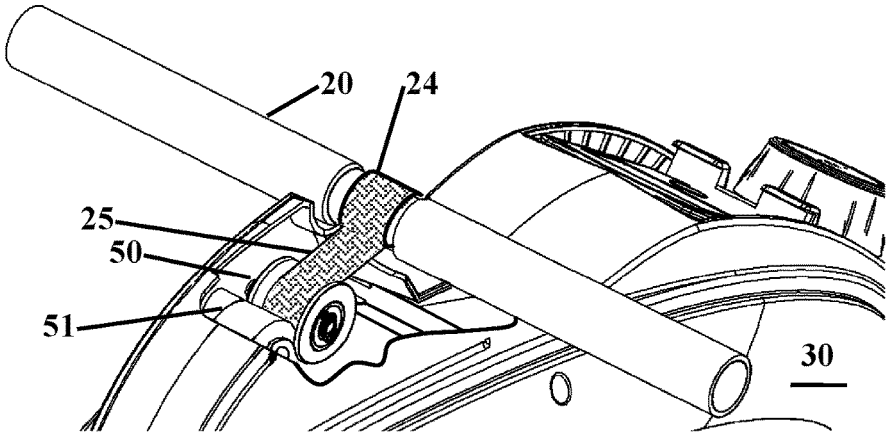
FIG. 6 shows a sectional view of the pull tube passing over the pulleys.
Figure 7:
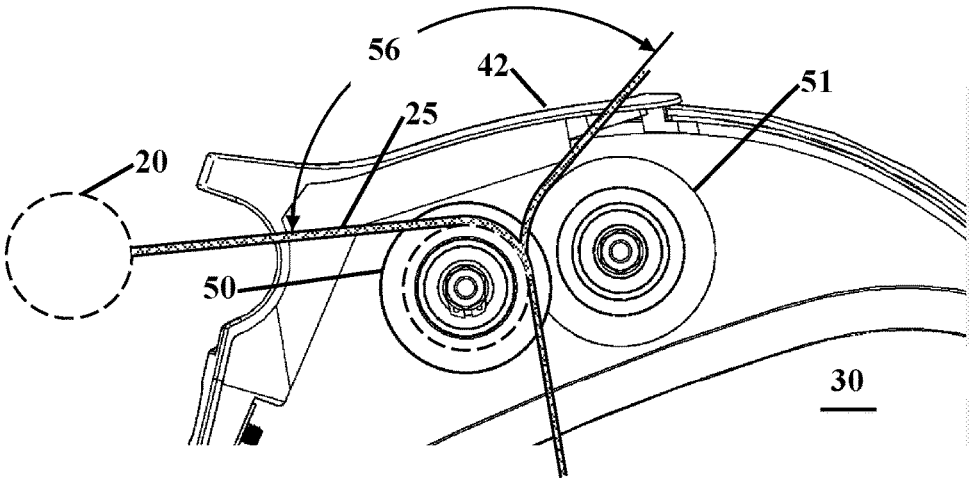
FIG. 7 shows the angles of entry of the strap entering the loading housing.

FIG. 5 shows a top perspective view of the pull tube 20 strap 21 or 22 (as shown in FIG. 1) entering the loading housing 30, FIG. 6 shows a sectional view of the strap curl position 21 or strap rowing position 22 connecting from the pull tube 20 passing over the pulleys and FIG. 7 shows the angles 56 of entry for the strap 25 to enter/exit the loading housing 30. To perform a variety of different exercises from rower, the strap is pulled vertically or at an angle through the shroud. The strap 25 is shown in the figures as strap curl position as the strap curl position 21 and strap row position 22. The shroud of the loading housing 30 has a large opening to allow for the additional exercises by pulling on the strap 25 from the loading housing 30. The pull tube 20 can be retained in a rowing position saddle or the pull tube 20D can be retained in a lifting position.

The strap 25 is guided over multiple pulleys 50, 51. The multiple pulleys 50, 51 both guide the strap 25 into the loading housing 30. The multiple pulleys 50, 51 also restrain side-to-side movement of the strap 25. The first pulley is a "U" pulley 50 with flanges to guide the side-to-side motion of the strap 25. Tapered pulley 51 guides the strap 25 when the tube 20 is pulled from the front end of the rowing machine. The "U" pulley 50 sandwiches the rowing strap 25 to guide and prevents the strap 25 from sliding out from between the pulleys.

In FIG. 7 the swing of the strap 25 is shown as angle 56. The angle 56 shows the two extreme pull positions where the strap 25 can be pulled. For a row pull, the strap 25 can be pulled below horizontal to about 45 degrees past vertical. The angle 56 is greater than 90 degrees, and is about 135 degrees of rotation. One pulley 51 has a tapered lip to center the pull strap 25 during operation. The strap wraps around 24 the pull tube 20 around one or both pulleys as shown in FIG. 6. The path of the strap 25 from outside of the loading housing 30 to the loading mechanism is shown and described in the following figures.

Figure 8:
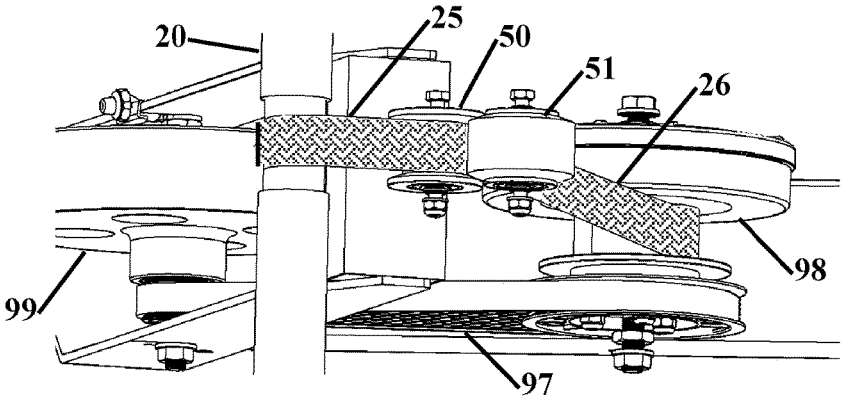
FIG. 8 shows the strap being guided through the pulleys.
Figure 9:
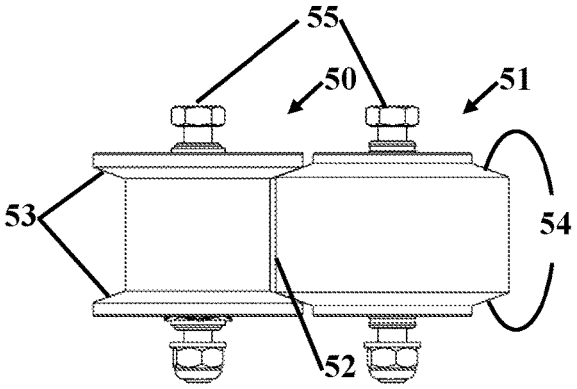
FIG. 9 shows the clearance through the pulleys.
Figure 10:
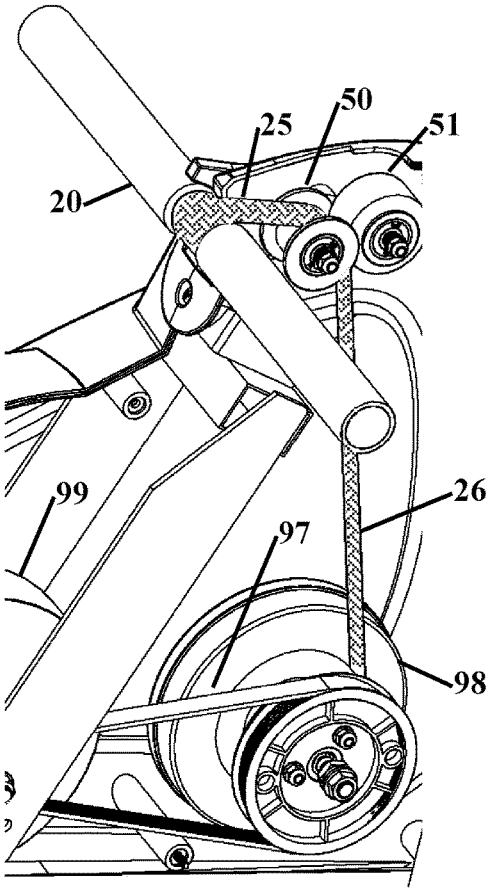
FIG. 10 shows the strap being guided into the retracting pulley.

FIG. 8 shows the strap 25 being guided through the pulleys 50 and 51, FIG. 9 shows the clearance or slot 52 through the pulleys 50/51 and FIG. 10 shows the strap 25 being guided into the retracting pulley 98. The strap 25 passes through the "U" pulley 50 and the tapered pulley 51. In FIG. 9, the taper 54 of the tapered pulley 50 is shown fitting with the flanges 53 of the "U" pulley 50. This keeps the strap 25 guided straight towards the retracting pulley 98 "nearly" regardless of the angle that the pull tube 20 is drawn out of the loading housing 30. The tapered pulley 51 at least partially engages within a portion of the "U" pulley 50. While the figures and description show a strap, it is contemplated that the strap can be a string that follows a similar path.

The retracting pulley 98 withdraws the strap transition 26 around the retracting pulley 98. The retracting pulley 98 is essentially a constant force spring on a one-way clutch. The one-way rotation of the clutch rotates a flywheel 99 through a belt 97 to provide an even resistance load from the inertia of the flywheel 99. A loading system places resistance on the flywheel or retracting mechanism to load the tension on the strap 25. The loading system can take a variety of different configurations including, but not limited to air, friction pad/brake, generator, alternator or magnetic/induction resistance.

Thus, specific embodiments of a rower with articulating footpads have been disclosed. It should be apparent, however, to those skilled in the art that many more modifications besides those described are possible without departing from the inventive concepts herein. The inventive subject matter, therefore, is not to be restricted except in the spirit of the appended claims.

Sequence Listing

Not Applicable.

The invention claimed is:

1. A rower with articulating footpads comprising:

a rowing machine;

said rowing machine having a housing to enclose a loading mechanism;

said loading mechanism having a strap that at least partially retracts within said housing;

said strap is guided into said housing between two pulleys in an opening of said housing;

said opening is configured to allow said strap to pass between said two pulleys at an angle greater than 90 degrees;

said housing is supported on at least one cross tube;

said cross tube has at least one wheel that is configured to allow rolling transportation of said rowing machine;

said cross tube includes at least one articulating footpad secured therein with a pivoting axis, whereby said at least one articulating footpad is arrangeable in a first position to provide a flat platform whereby allowing a user to stand on said platform and a second position to allow use of said at least one wheel to move said rowing machine and said at least one articulating footpad is configured to allow said at least one wheel to be enclosed under said at least one articulating footpad.

2. The rower with articulating footpads according to claim 1, wherein said angle is at least 135 degrees.

3. The rower with articulating footpads according to claim 1, wherein said at least one articulating footpad has two footpads that are located on opposing sides of said housing and when articulated they locate on opposing sides of said housing.

4. The rower with articulating footpads according to claim 3, wherein said two footpads are linked together.

5. The rower with articulating footpads according to claim 1, wherein said at least one articulating footpad is configured to allow a user to stand on said at least one articulating footpad when said at least one articulating footpad is in said first position.

6. The rower with articulating footpads according to claim 5, wherein said standing user creates a vertical load that resists lifting forces that are created by pulling on said strap.

7. The rower with articulating footpads according to claim 1, wherein said at least one articulating footpad is configured to pivot over said at least one cross tube whereby at least a portion of said at least one cross tube is covered by said at least one articulating footpad.

8. The rower with articulating footpads according to claim 1, wherein said rowing machine has a seat on a slider.

9. The rower with articulating footpads according to claim 8, further includes a set of rowing foot restraints.

10. The rower with articulating footpads according to claim 1, wherein said strap is secured at a first end within said housing and at a second end on a pull tube.

11. The rower with articulating footpads according to claim 10, wherein a first of said one of said two pulleys at least partially engages within a portion of a second of said two pulleys.

12. The rower with articulating footpads according to claim 11, wherein said first of said two pulleys presses said strap within said second of said two pulleys.

13. The rower with articulating footpads according to claim 12, wherein at least one of said two pulleys allows said strap to be guided over said at least one articulating footpad.

14. A rower with footpads comprising:

a rowing machine;

said rowing machine having a housing to enclose a loading mechanism;

said loading mechanism having a strap that at least partially retracts within said housing;

said strap is guided into said housing between two pulleys in an opening of said housing;

wherein a first of said one of said two pulleys is a "U" pulley with tapered flanges and a second of said two pulleys has tapered sides that fit within said tapered flanges;

said tapered flanges of said "U" pulley are configured to guide and track said strap into and out of said housing and said loading mechanism;

said rowing machine has rowing foot restraints and a seat on a slider that are configured to allow a user to pull said strap from said housing;

said opening is configured to allow said strap to pass between said two pulleys at an angle greater than 90 degrees;

said housing is supported on at least one cross tube, and said cross tube includes at least one footpad secured therein, whereby configured for said user to stand on said at least one footpad and pull said strap from said housing.

15. The rower with footpads according to claim 14, wherein said angle is at least 135 degrees.

16. The rower with footpads according to claim 14, wherein there are two footpads located on opposing sides of said housing.

17. The rower with footpads according to claim 14, wherein said first of said one of said two pulleys mates within said second of said two pulleys.

18. The rower with footpads according to claim 17, wherein said first of said two pulleys presses said strap within said second of said two pulleys.

19. The rower with footpads according to claim 18, wherein at least one of said two pulleys allows said strap to be guided over said at least one footpad.

20. The rower with articulating footpads according to claim 14, wherein said rowing machine has a seat on a slider.

21. The rower with articulating footpads according to claim 14, wherein said at least one footpad is arrangeable in a first position to provide a flat platform whereby allowing a user to stand on said platform and a second position to allow use of said at least one wheel to move said rowing machine and said at least one footpad is configured to allow said at least one wheel to be enclosed under said at least one footpad.

* * * * *